US011530675B1

(12) United States Patent
Takemitsu et al.

(10) Patent No.: US 11,530,675 B1
(45) Date of Patent: Dec. 20, 2022

(54) CONTROL DEVICE FOR ROTARY ENGINE

(71) Applicant: MAZDA MOTOR CORPORATION, Hiroshima (JP)

(72) Inventors: Takaaki Takemitsu, Hiroshima (JP); Koji Bekki, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 0 days.

(21) Appl. No.: 17/738,204

(22) Filed: May 6, 2022

(30) Foreign Application Priority Data

May 31, 2021 (JP) ..... JP2021-091084

(51) Int. Cl.
*F02N 11/08* (2006.01)
*F02B 53/00* (2006.01)

(52) U.S. Cl.
CPC ..... *F02N 11/0848* (2013.01); *F02N 11/0811* (2013.01); *F02B 2053/005* (2013.01); *F02N 2200/021* (2013.01); *F02N 2200/042* (2013.01); *F02N 2250/04* (2013.01); *F02N 2300/106* (2013.01)

(58) Field of Classification Search
CPC ..... F02N 11/0848; F02N 11/0811; F02N 2200/021; F02N 2200/042; F02N 2250/04; F02N 2300/106; F02B 2053/005
USPC ..... 123/179.3, 179.4, 179.25, 200, 201; 701/112, 113
See application file for complete search history.

(56) References Cited

FOREIGN PATENT DOCUMENTS

JP 2010-174740 A 8/2010
JP 2014-47746 A 3/2014

*Primary Examiner* — Hai H Huynh
(74) *Attorney, Agent, or Firm* — Studebaker & Brackett PC

(57) ABSTRACT

A control device prevents damage due to backward rotation of a rotary engine and prevents misjudgment of backward rotation of the rotary engine. The control device for a rotary engine includes a motor mechanically connected to the shaft of the rotary engine, a controller (a motor ECU) that performs energization control of the motor to start the rotary engine by driving the motor, and a sensor (such as a motor rotation sensor). When starting the rotary engine, the controller stops energization to the motor based on an electric signal from the sensor when the shaft of the rotary engine rotates backward a predetermined angle or more, and then the shaft of the rotary engine continues to rotate backward for a predetermined time.

16 Claims, 10 Drawing Sheets

CONTROL DEVICE FOR ROTARY ENGINE

TECHNICAL FIELD

The technology disclosed herein relates to a control device for a rotary engine.

BACKGROUND

Japanese Patent document JP-A-2014-47746 describes an engine in which idling stop is performed. In this engine, when a sensor detects the backward rotation of the engine at the time of a restart, the controller stops fuel injection and ignition in the cylinder. This avoids damage to the engine.

Japanese Patent document JP-A-2010-174740 describes a rotary engine. The intake port of this rotary engine is opened in the side housing.

SUMMARY

When the rotary engine rotates backward, the end of the side seal interferes with the opening of the intake port formed in the side housing, possibly damaging the side seal. Damage to the side seal reduces the fuel efficiency and the emission performance of the rotary engine. When the rotary engine rotates backward, it is desirable to stop the rotary engine immediately.

The backward rotation of the shaft needs to be detected immediately to immediately stop the backward rotation of the rotary engine. However, if the backward rotation of the shaft is determined when the shaft rotates in the backward rotation direction by a small angle and/or when the shaft rotates in the backward rotation direction by a small amount of time, a misjudgment easily occurs.

The technology disclosed herein achieves both the avoidance of damage caused by the backward rotation of the rotary engine and the avoidance of a misjudgment of the backward rotation of the rotary engine.

The technology disclosed herein relates to a control device for a rotary engine. This control device for a rotary engine includes: a rotary engine having an intake port opened in a side housing; a motor mechanically connected to a shaft of the rotary engine; a controller that performs energization control of the motor so as to start the rotary engine by driving the motor; and a sensor that outputs an electric signal concerning a rotation direction of the rotary engine to the controller, in which the controller stops energization to the motor based on the electric signal from the sensor when the shaft of the rotary engine rotates backward a predetermined angle or more and then the shaft of the rotary engine continues to rotate backward for a predetermined time or more at a start of the rotary engine.

According to this structure, the controller determines the backward rotation of the rotary engine when the following condition is met at a start of the rotary engine. The condition is that the shaft of the rotary engine rotates a predetermined angle or more and then the shaft of the rotary engine continues to rotate backward for a predetermined time.

The controller acquires information about the rotation of the rotary engine based on an electric signal from the sensor. The sensor outputs an electric signal concerning the rotation direction of the rotary engine.

When the rotary engine is started by using the motor as a starter, the rotary engine may vibrate in the forward rotation direction and the backward rotation direction. When the rotation angle of the shaft is less than a predetermined angle even if a vibration occurs, the controller does not determine that the rotary engine has rotated backward.

In addition, noise in the electric signal from the sensor may cause a misjudgment of the controller. Even when noise is generated, the rotary engine does not determine that the rotary engine has rotated backward unless the rotary engine continues backward rotation for a predetermined time. Since the controller determines the backward rotation of the rotary engine based on the condition in which the parameter corresponding to the rotation angle of the shaft is combined with the parameter corresponding to the continuation time of backward rotation, a misjudgment is avoided.

When the condition described above is met, the controller stops energization to the motor. This can stop the backward rotation of the rotary engine before the end of the side seal interferes with the opening of the intake port formed in the side housing. Accordingly, the damage to the rotary engine caused by the backward rotation of the rotary engine is avoided.

Accordingly, the structure described above achieves both the avoidance of damage caused by the backward rotation of the rotary engine and the avoidance of a misjudgment of the backward rotation of the rotary engine.

The controller may stop energization to the motor so that the shaft of the rotary engine stops before the shaft rotates 70 degrees after the start of backward rotation.

When the operating rotary engine stops, the rotor stops in the state in which one of the operating chambers has shifted from the middle period of the compression stroke to the later period thereof. This is because, in the state in which energization to the motor stops and the rotary engine is rotating due to inertia, the pressures in the operating chamber rises as the compression stroke advances to the beginning period, the middle period, and the later period, and this causes the rotation resistance of the rotary engine. More specifically, the rotary engine stops at a rotational position of approximately 90 degrees ATDC.

In the rotary engine having a substantially triangular rotor, a rotor containing chamber is divided into a region corresponding to the intake stroke and the exhaust stroke and a region corresponding to the compression stroke and the expansion stroke with respect to the major axis as the boundary. The intake port is opened in the side housing in the region corresponding to the intake stroke. The inventors of the present application have found the following regarding the backward rotation of the rotary engine. That is, if the shaft of the rotary engine that stops at a rotational position of 90 degrees ATDC described above rotates backward 135 degrees or more, the end of the side seal may interfere with the opening of the intake port.

Accordingly, damage due to the backward rotation of the rotary engine can be avoided by stopping energization to the motor so that the shaft of the rotary engine stops before the shaft rotates 70 degrees from the start of the backward rotation in consideration of the safety rate. It should be noted that, as described above, the shaft of the rotary engine continues to rotate due to inertia even after the energization to the motor is stopped. Energization to the motor is stopped so that the shaft of the rotary engine stops before the shaft rotates 70 degrees from the start of the backward rotation in consideration of the continuation of the rotation due to inertia.

The predetermined angle may be 5 degrees in 10 milliseconds after the start of backward rotation.

The controller can distinguish between vibrations generated at the start of the rotary engine and the backward rotation of the shaft of the rotary engine based on this condition.

The predetermined time may be 5 milliseconds.

Based on this condition, the controller can determine that the rotary engine is rotating backward while excluding the effect of noise in the electric signal from the sensor.

The controller may estimate, based on a maximum starting torque of the motor and inertia of the rotary engine, a rotation angle of the shaft when stopping energization to the motor after a lapse of 15 milliseconds from a start of backward rotation and, when the estimated rotation angle exceeds 70 degrees, the controller may change a rotational position of the shaft before starting the rotary engine to a positive rotation direction using the motor.

When it is assumed that the motor rotates backward at the start of the rotary engine and then stops after the supply of electric power to the motor continues for 15 milliseconds, the rotation angle of the shaft of the rotary engine can be calculated based on the maximum starting torque of the motor and the inertia of the rotary engine. When the rotation angle of the shaft exceeds 70 degrees, the end of the side seal may interfere with the opening of the intake port formed in the side housing.

When the estimated rotation angle of the shaft exceeds 70 degrees, the controller changes the rotational position of the shaft before starting the rotary engine in the forward rotation direction using the motor. This advances the rotational position of the shaft at the start of the rotary engine from 90 degrees ATDC. Therefore, even if the shaft rotates backward more than 70 degrees at the start of the rotary engine, the interference between the end of the side seal and the opening of the intake port is prevented. Both the avoidance of damage caused by the backward rotation of the rotary engine and the avoidance of a misjudgment of the backward rotation of the rotary engine are achieved.

The controller may estimate, based on a maximum starting torque of the motor and inertia of the rotary engine, a rotation angle of the shaft when stopping energization to the motor after a lapse of 15 milliseconds from the start of backward rotation, and, when an end of a side seal of the rotary engine interferes with an opening of the intake port if the shaft rotates backward the estimated rotation angle, the controller may change a rotational position of the shaft before starting the rotary engine to a forward rotation direction using the motor.

Similar to the above, the controller estimates the rotation angle of the shaft of the rotary engine when it is assumed that the motor rotates backward and the backward rotation continues for 15 milliseconds.

Unlike the structure described above, when the shaft rotates backward the estimated rotation angle, the controller determines whether the end of the side seal of the rotary engine interferes with the opening of the intake port based on the rotational position of the shaft at the start of the rotary engine. This is because the rotary engine does not always stop at a certain position. When determining that the interference occurs, the controller changes the rotational position of the shaft in the forward rotation direction using the motor.

This further advances the rotational position of the shaft at the start of the rotary engine in the forward rotation direction. Even if energization to the motor continues for 15 milliseconds and the shaft rotates backward during the energization, the interference between the end of the side seal and the opening of the intake port formed in the side housing is prevented. Both the avoidance of damage caused by the backward rotation of the rotary engine and the avoidance of a misjudgment of the backward rotation of the rotary engine are achieved.

As described above, the control device for a rotary engine can achieve both the avoidance of damage caused by the backward rotation of the rotary engine and the avoidance of a misjudgment of the backward rotation of the rotary engine.

DETAILED DESCRIPTION

A control device for a rotary engine according to an embodiment will be described below with reference to the drawings. The control device for a rotary engine described here is an example.

Structure of Electric Vehicle

Figure 1:
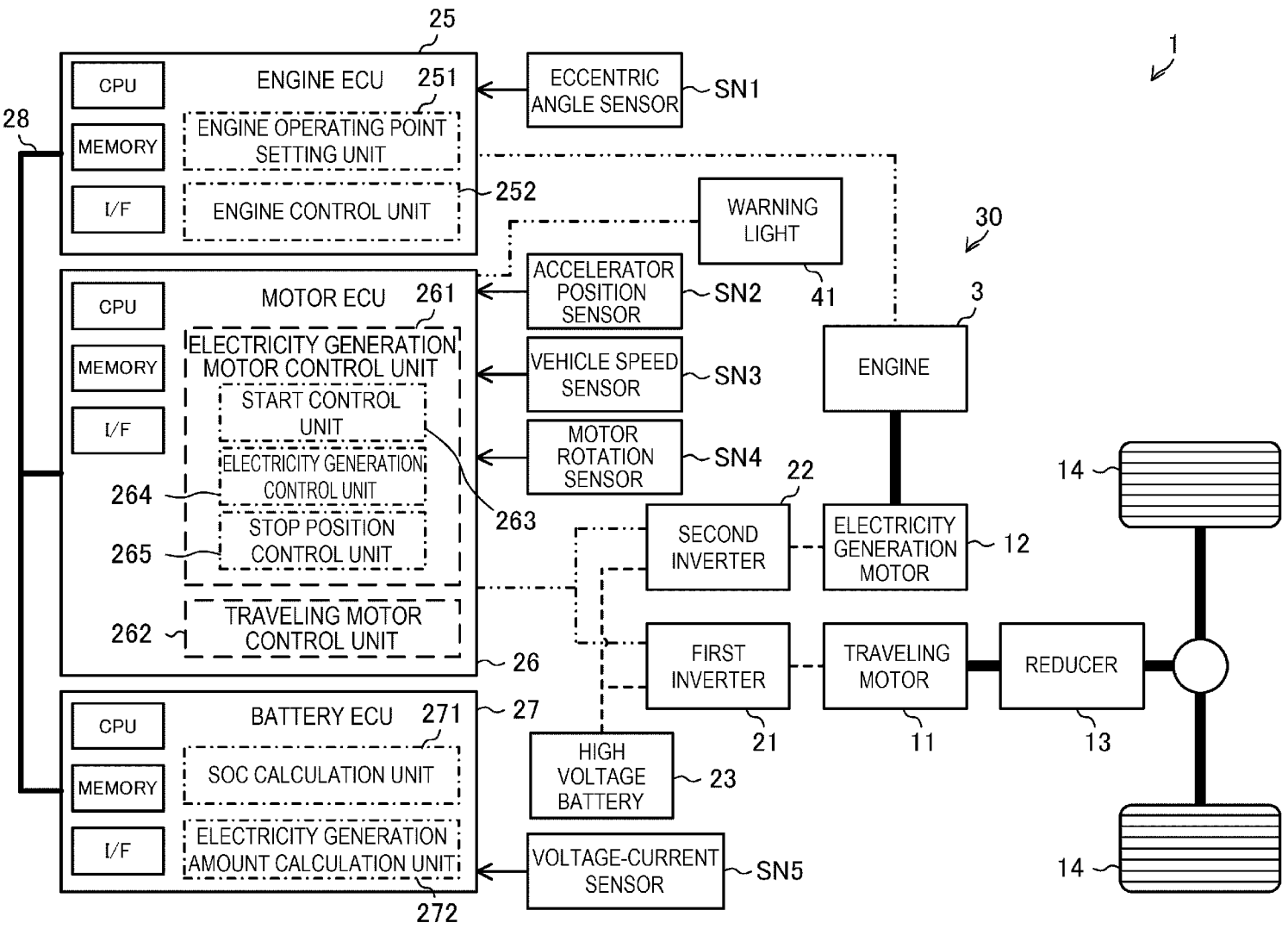
FIG. 1 illustrates an exemplary control system for an electric vehicle.

FIG. 1 illustrates a control system for an electric vehicle. An electric vehicle 1 has a traveling motor 11 for traveling. The traveling motor 11 is mechanically connected to drive wheels 14 and 14 via a reducer 13. The reducer 13 reduces the output of the traveling motor 11. When the output of the traveling motor 11 is transmitted to the drive wheels 14 and 14, the electric vehicle 1 travels.

The electric vehicle 1 has a high voltage battery 23. The high voltage battery 23 stores electric power for traveling. The high voltage battery 23 is, for example, a lithium-ion battery.

The traveling motor 11 is electrically connected to the high voltage battery 23 via a first inverter 21. The traveling motor 11 and the first inverter 21 are electrically connected to each other via a harness line indicated as a dashed line in FIG. 1, and the first inverter 21 and the high voltage battery 23 are electrically connected to each other via a harness line. The traveling motor 11 performs power running by receiving the supply of electric power from the high voltage battery 23. The traveling motor 11 also performs electricity generation driving when the electric vehicle 1 decelerates. The first inverter 21 supplies the regenerative electric power from the traveling motor 11 to the high voltage battery 23. The high voltage battery 23 is charged with the regenerative electric power from the traveling motor 11.

The electric vehicle 1 has a range extender device 30. The range extender device 30 includes an electricity generation motor 12 for electricity generation and an internal combustion engine that operates the electricity generation motor 12.

In the electric vehicle 1 illustrated here, the internal combustion engine is a rotary engine 3.

The shaft of the rotary engine 3 is mechanically connected to the electricity generation motor 12. When the rotary engine 3 operates, the electricity generation motor 12 performs electricity generation driving. It should be noted that the structure of the rotary engine 3 will be described in detail later.

The electricity generation motor 12 is connected to the high voltage battery 23 via a second inverter 22. The electricity generation motor 12 and the second inverter 22 are electrically connected to each other via a harness line indicated as a dashed line in FIG. 1, and the second inverter 22 and the high voltage battery 23 are electrically connected to each other via a harness line. The second inverter 22 supplies the electricity generated by the electricity generation motor 12 to the high voltage battery 23. The high voltage battery 23 is charged with the electricity generated by the electricity generation motor 12. It should be noted that, as described later, the electricity generation motor 12 may perform power running by receiving the supply of electric power from the high voltage battery 23. The electricity generation motor 12 also functions as a starter. The electricity generation motor 12 starts the rotary engine 3 by giving a cranking torque to the rotary engine 3.

The electric vehicle 1 includes an engine ECU (electric control unit) 25, a motor ECU 26, and a battery ECU 27. Each of the engine ECU 25, the motor ECU 26, and the battery ECU 27 is a controller that is based on a well-known microcomputer. Each of the ECUs includes a central processing unit (CPU), a memory, and an I/F circuit. The CPU executes programs. The memory includes, for example, a random access memory (RAM) and a read only memory (ROM). The memory stores programs and data. The I/F circuit receives and outputs electric signals.

The engine ECU 25, the motor ECU 26, and the battery ECU 27 are connected to each other via a CAN (car area network) communication lines 28. The engine ECU 25, the motor ECU 26, and the battery ECU 27 can transmit and receive signals to and from each other via the CAN communication line 28.

The engine ECU 25 is electrically connected to the rotary engine 3 via the signal line indicated by a dot-dot-dash line. The engine ECU 25 controls the rotary engine 3. An eccentric angle sensor SN1 is connected to the engine ECU 25. The eccentric angle sensor SN1 outputs a signal concerning the rotation of an eccentric shaft 35, which is the output shaft of the rotary engine 3. The engine ECU 25 can acquire information about the rotational position of the rotary engine 3 based on the signal from the eccentric angle sensor SN1.

The engine ECU 25 has an engine operating point setting unit 251 and an engine control unit 252 as functional blocks. Details on the control of the rotary engine 3 by the engine ECU 25 will be described later.

The motor ECU 26 is electrically connected to the first inverter 21 and the second inverter 22 via signal lines indicated by dot-dot-dash lines. The motor ECU 26 controls the traveling motor 11 through the first inverter 21. The motor ECU 26 controls the electricity generation motor 12 through the second inverter 22.

An accelerator position sensor SN2, a vehicle speed sensor SN3, and a motor rotation sensor SN4 are connected to the motor ECU 26. The accelerator position sensor SN2 outputs a signal corresponding to the amount of depression of the accelerator pedal to the motor ECU 26. The vehicle speed sensor SN3 outputs a signal corresponding to the speed of the electric vehicle 1 to the motor ECU 26.

The motor rotation sensor SN4 outputs a signal concerning the rotation of the electricity generation motor 12 to the motor ECU 26. The motor rotation sensor SN4 includes a plurality of photointerrupters disposed at a plurality of positions that are different in the circumferential direction in the shaft of the electricity generation motor 12. Since the phases of the output signals of the plurality of photointerrupters are different from each other, the motor ECU 26 can determine the rotation direction (that is, the forward rotation or the backward rotation) of the electricity generation motor 12. The motor ECU 26 can also grasp the rotation angle of the eccentric shaft 35 of the rotary engine 3 to which the electricity generation motor 12 is mechanically connected, based on the signal from the motor rotation sensor SN4.

The motor rotation sensor SN4 also outputs a signal concerning the rotation of the traveling motor 11 to the motor ECU 26.

The motor ECU 26 has an electricity generation motor control unit 261 and a traveling motor control unit 262 as functional blocks. The electricity generation motor control unit 261 includes a start control unit 263, an electricity generation control unit 264, and a stop position control unit 265. Details on the control of the electricity generation motor 12 by the electricity generation motor control unit 261 will be described later.

The traveling motor control unit 262 controls the traveling motor 11 based on the signals from the accelerator position sensor SN2, the vehicle speed sensor SN3, and the motor rotation sensor SN4. Therefore, the electric vehicle 1 performs acceleration or deceleration according to the operation of the accelerator pedal by the driver.

A voltage-current sensor SN5 is connected to the battery ECU 27. The voltage-current sensor SN5 outputs a signal concerning the output voltage and output current of the high voltage battery 23 to the battery ECU 27. The battery ECU 27 has an SOC calculation unit 271 and an electricity generation amount calculation unit 272 as functional blocks. The SOC calculation unit 271 calculates the state (SOC) of charge of the high voltage battery 23 based on a signal from the voltage-current sensor SN5. The generated power calculating unit 272 calculates the target electricity generation amount when the high voltage battery 23 needs to be charged, based on the SOC of the high voltage battery 23.

A warning light 41 of the meter panel is electrically connected to the motor ECU 26. The warning light 41 lights up when receiving a signal from the motor ECU 26 and warns the driver.

Structure of Rotary Engine

Figure 2:
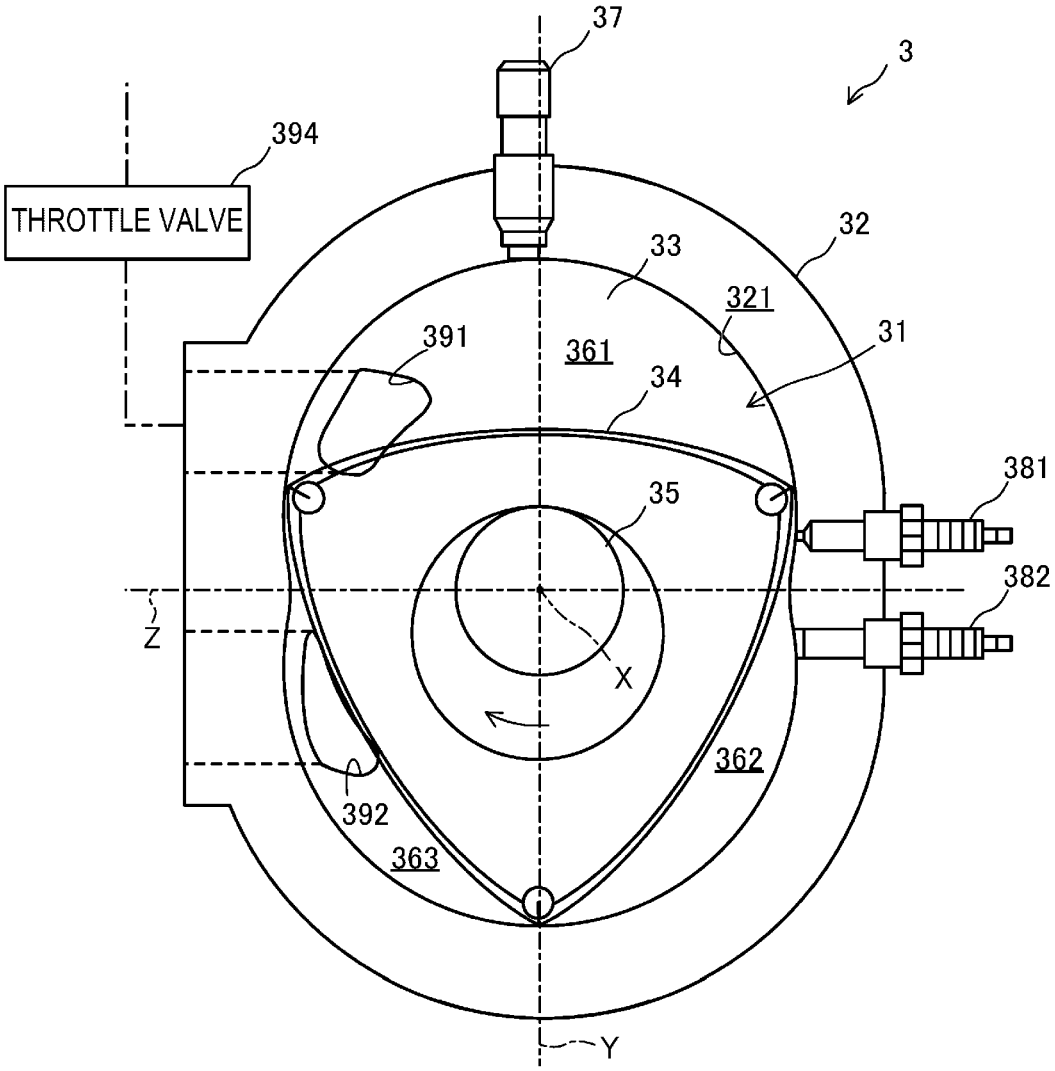
FIG. 2 illustrates an exemplary rotary engine.

FIG. 2 illustrates the rotary engine 3. FIG. 2 illustrates the internal structure of the rotary engine 3 as seen from the front. The front-rear direction of the rotary engine 3 is the shaft direction of the eccentric shaft 35, which is orthogonal to the sheet in FIG. 2.

The rotary engine 3 has one rotor 34 and a rotor containing chamber 31. The rotor containing chamber 31 is formed by a rotor housing 32 and a side housing 33. The rotor housing 32 has a trochoidal inner circumferential surface 321. The rotor 34 is accommodated in the rotor containing chamber 31. The rotor 34 is roughly triangular. The rotor containing chamber 31 is divided by the rotor 34 into three operating chambers: a first chamber 361, a second chamber 362, and a third chamber 363.

The eccentric shaft 35 is provided so as to pass through the rotor containing chamber 31. The rotor 34 is supported so as to perform sun-and-planet rotary motion relative to the eccentric shaft 35. The rotor 34 rotates about the eccentric shaft 35 so that the three apex portions of the rotor 34 move along the trochoidal inner circumferential surface 321.

Figure 4:
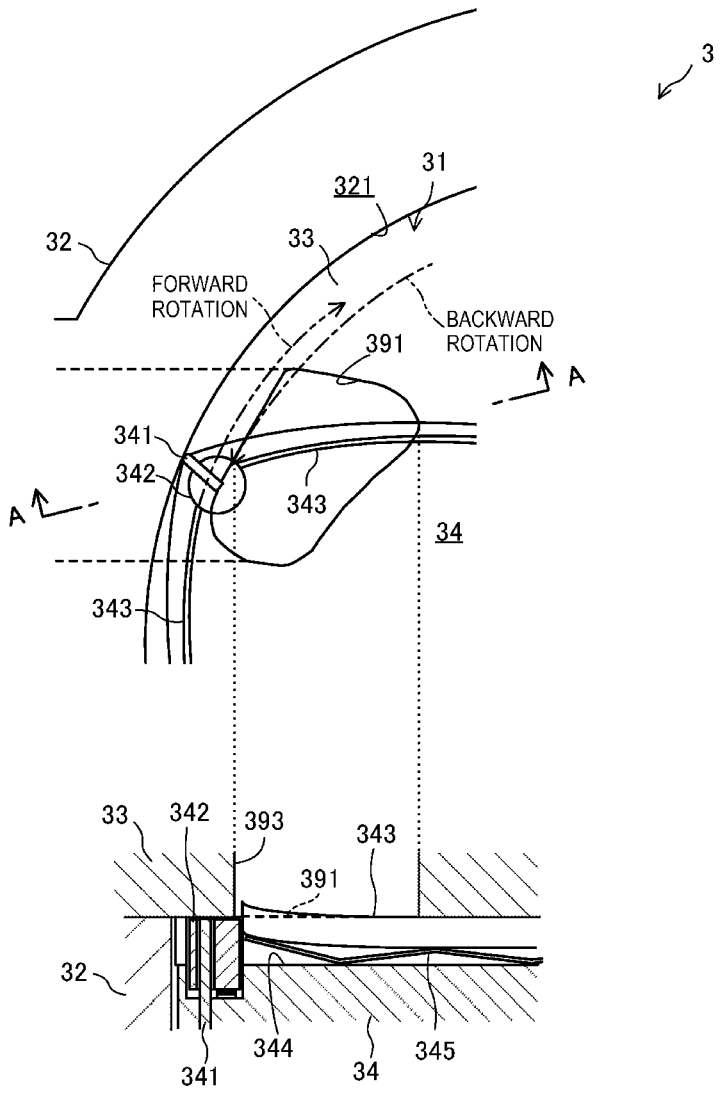
FIG. 4 illustrates an state of the interference between a side seal and an intake port of the exemplary rotary engine.

As illustrated in an enlarged view in FIG. 4, apex seals 341 are attached to the apex portions of the rotor 34. A substantially cylindrical corner seal 342 is provided in each of the front and rear end portions of each of the apex seals 341. In addition, a side seal 343 is provided on each of the front and rear side surfaces of the rotor 34. The side seal 343 connects the corner seals 342 to each other so that the corner seals 342 are substantially parallel to the outer circumferential edge of the rotor 34.

The apex seals 341 make contact with the trochoidal inner circumferential surface 321 of the rotor housing 32. This causes the apex seals 341 to keep the operating chambers airtight. The side seals 343 make contact with the side housing 33. This causes the side seals 343 to keep the operating chambers airtight. The corner seal 342 keeps the joint portion between the side seals 343 and the apex seal 341 airtight.

As the rotor 34 rotates as indicated by the arrow in FIG. 2, the first chamber 361, the second chamber 362, and the third chamber 363 change around the eccentric shaft 35, and the intake stroke, the compression stroke, the expansion stroke, and the exhaust stroke take place in the first chamber 361, the second chamber 362, and the third chamber 363. The rotational force generated by this is output through the eccentric shaft 35.

More specifically, the rotor 34 rotates clockwise in FIG. 2. The rotor containing chamber 31 is divided into an upper left region, an upper right region, a lower right region, and a lower left region by a major axis Y and a minor axis Z that pass through a rotary shaft center X. In the operating chambers, generally the intake stroke is performed in the upper left region, generally the compression stroke is performed in the upper right region, generally the expansion process is performed in the lower right region, and generally the exhaust process is performed in the lower left region.

An injector 37, a first spark plug 381, and a second spark plug 382 are mounted to the rotor housing 32. The injectors 37 is mounted to the top portion of the rotor housing 32. The injector 37 injects fuel into the operating chamber in the intake stroke or the compression stroke.

The first spark plug 381 is mounted to the right wall portion of the rotor housing 32. The second spark plug 382 is also mounted to the right wall portion of the rotor housing 32. The second spark plug 382 is located on the advancing side of the rotor 34 as seen from the first spark plug 381. The first spark plug 381 and the second spark plug 382 ignite the air-fuel mixture in the operating chamber in the compression stroke.

An intake port 391 and an exhaust port 392 are opened in the side housing 33. The opening of the intake port 391 is located in the upper left region of the rotor containing chamber 31. In the side housing 33, the intake port 391 extends horizontally to the left from this opening in a substantially linear manner. The opening of the intake port 391 opens and closes with the rotation of the rotor 34. The intake port 391 communicates with the inside of the operating chamber in the intake stroke. The intake port 391 is connected to the intake passage. A throttle valve 394 is provided in the intake passage. The throttle valve 394 adjusts the amount of air to be supplied to the rotary engine 3.

The opening of the exhaust port 392 is located in the lower left region of the rotor containing chamber 31. The opening of the exhaust port 392 is located below the opening of the intake port 391. In the side housing 33, the exhaust port 392 extends horizontally to the left from this opening in a substantially linear manner. The opening of the exhaust port 392 opens and closes with the rotation of the rotor 34. The exhaust port 392 communicates with the operating chamber in the exhaust process.

Figure 3:
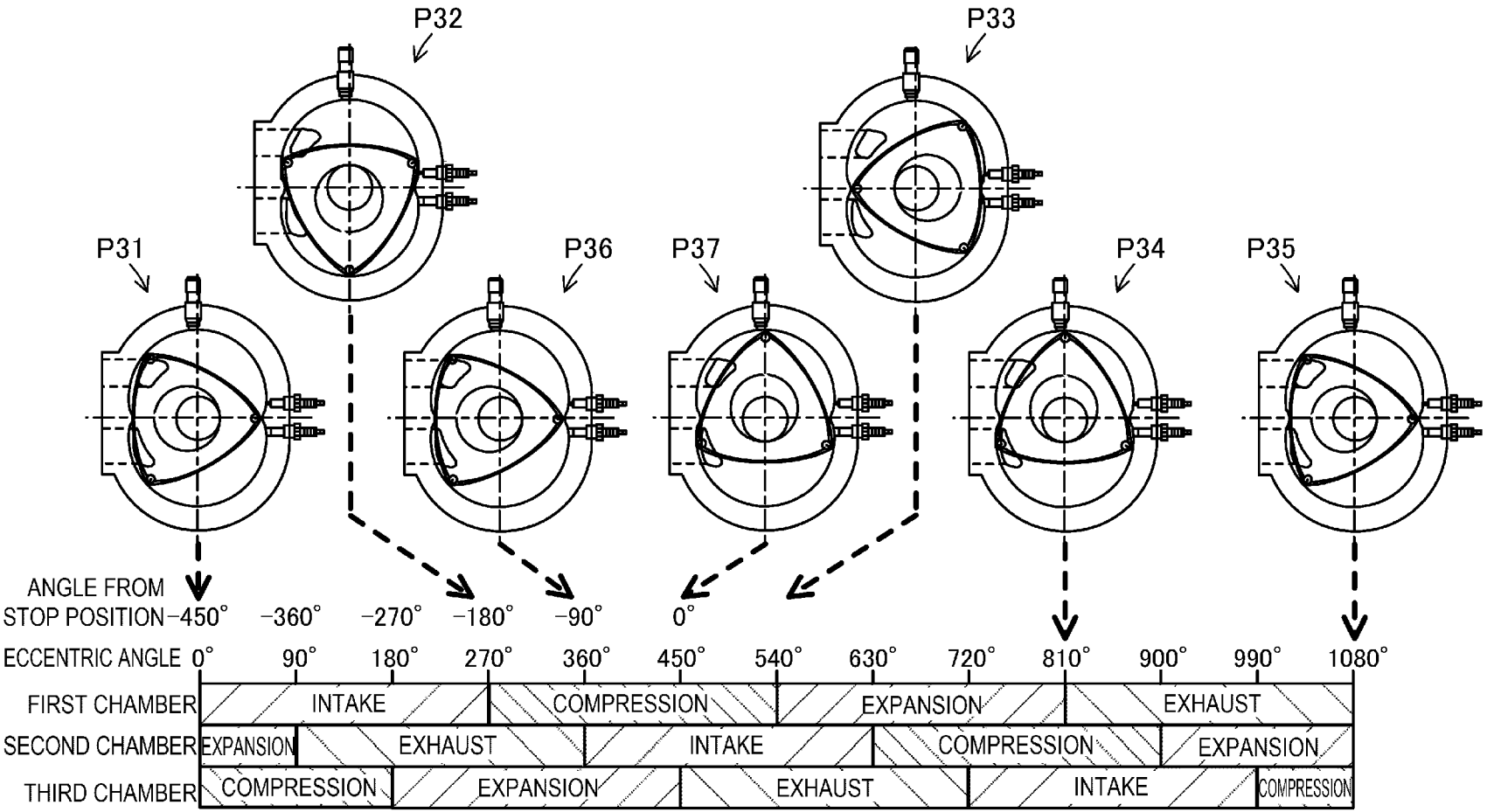
FIG. 3 illustrates an operation of the exemplary rotary engine.

FIG. 3 illustrates the transitions between the strokes in the operating chambers of the rotary engine 3. One stroke in one operating chamber corresponds to the period required for the eccentric shaft 35 to rotate 270 degrees. P31 represents the rotary engine 3 in which the first chamber corresponds to the start timing of the intake stroke. P32 represents the rotary engine 3 in which the first chamber corresponds to the end timing of the intake stroke and the start timing of the compression stroke. P33 represents the rotary engine 3 in which the first chamber corresponds to the end timing of the compression stroke and the start timing of the expansion process. P33 represents the compression top dead center of the first chamber. P34 represents the rotary engine 3 in which the first chamber corresponds to the end timing of the expansion process and the start timing of the exhaust process. P35 represents the rotary engine 3 in which the first chamber corresponds to the end timing of the exhaust stroke. P35 is the same as P31.

One cycle in the operating chamber that includes the intake stroke, the compression stroke, the expansion stroke, and the exhaust processes corresponds to the period required for the eccentric shaft 35 to rotate 1080 degrees. In addition, the phase of the second chamber 362 is 360 degrees later than the phase of the first chamber 361. The phase of the third chamber is 360 degrees later than the phase of the second chamber 362.

Electricity Generation Control of Electric Vehicle

Next, the electricity generation control of the electric vehicle 1 will be described with reference to FIGS. 5 to 6. First, the flowchart on the left side in FIG. 5 indicates the management procedure for the high voltage battery 23 to be performed by the battery ECU 27.

In step S51 after the start, first, the SOC calculation unit 271 of the battery ECU 27 calculates the SOC of the high voltage battery 23 based on the signal from the voltage-current sensor SN5. In subsequent step S52, the battery ECU 27 determines whether the calculated SOC is less than a first reference SOC1. In the case of YES in step S52, the process proceeds to step S53. The battery ECU 27 determines that the high voltage battery 23 needs to be charged. In the case of NO in step S52, the process returns to step S51.

In step S53, the battery ECU 27 calculates the reduction rate of the SOC. In subsequent step S54, the electricity generation amount calculation unit 272 of the battery ECU 27 calculates the target electricity generation amount according to the calculated reduction rate of the SOC. The battery ECU 27 makes the target electricity generation amount larger as the reduction rate is higher.

After calculating the target electricity generation amount, the battery ECU 27 outputs electricity generation requests to the engine ECU 25 and the motor ECU 26 via the CAN communication line 28 in step S55.

In step S56, the battery ECU 27 determines whether the rotary engine 3 has started based on information from the engine ECU 25. The process repeats step S56 until the rotary engine 3 has started, and then the process proceeds to step S57 when the rotary engine 3 has started.

When the rotary engine 3 has started and the electricity generation by the motor 12 has started, the SOC calculation unit 271 of the battery ECU 27 calculates the SOC of the high voltage battery 23 in step S57. In subsequent step S58, the battery ECU 27 determines whether the calculated SOC exceeds a second reference SOC2. In the case of NO in step S58, the process returns to step S57 and the battery ECU 27 instructs the continuation of electricity generation. In the case of YES in step S58, the process proceeds to step S59. In step S59, the battery ECU 27 determines that the high voltage battery 23 has been charged and outputs the end of electricity generation to the engine ECU 25 and the motor ECU 26 via the CAN communication line 28.

Figure 5:
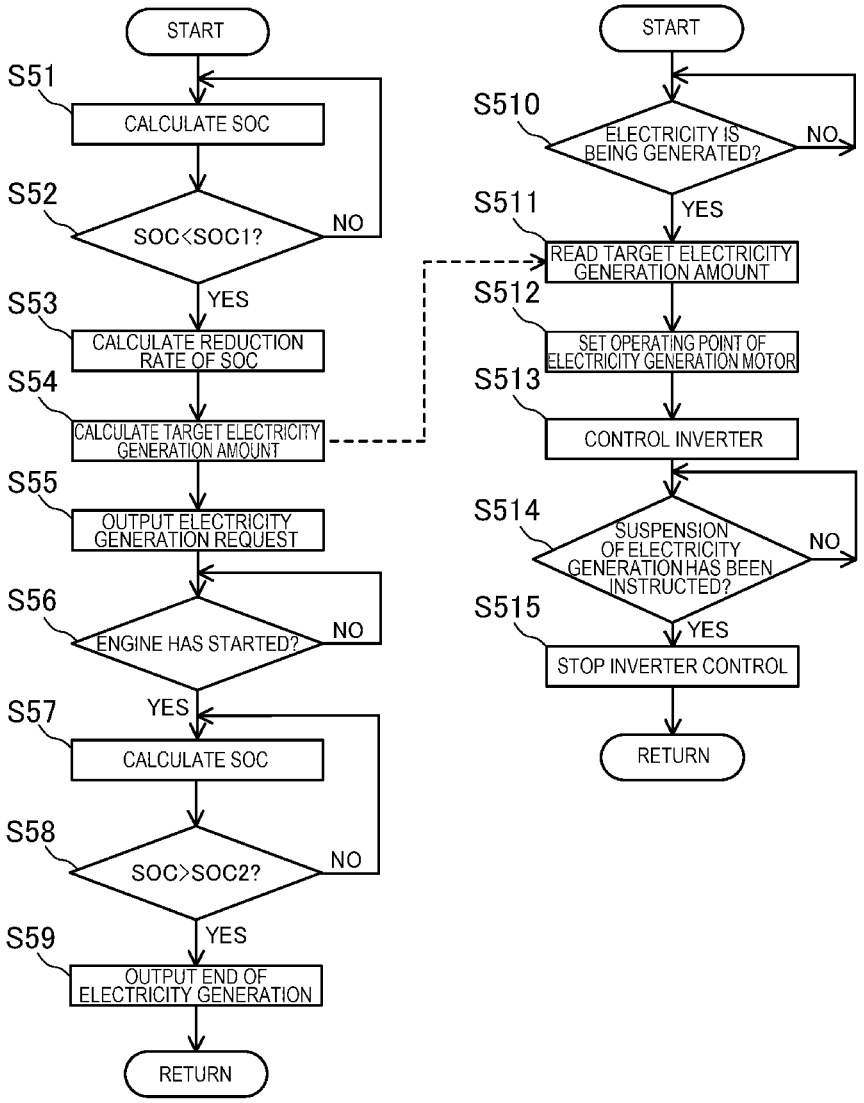
FIG. 5 illustrates a procedure for exemplary battery management and a procedure for exemplary motor control.

The flowchart on the right side in FIG. 5 indicates the control procedure for the electricity generation motor 12 during electricity generation to be performed by the motor ECU 26. In step S510 after the start, first, the motor ECU 26 determines whether electricity is being generated in response to an electricity generation request from the battery ECU 27. The process repeats step S510 when electricity is not being generated or the process proceeds to step S511 when electricity is being generated.

In step S511, the electricity generation control unit 264 of the motor ECU 26 reads the target electricity generation amount calculated by the battery ECU 27. In subsequent step S512, the electricity generation control unit 264 sets the operating point of the electricity generation motor 12 based on the target electricity generation amount. In addition, in step S513, the electricity generation control unit 264 controls the second inverter 22 so that the electricity generation motor 12 operates at the set operating point.

In step S514, the electricity generation control unit 264 of the motor ECU 26 determines whether the suspension of electricity generation has been instructed. The process repeats step S513 while the suspension of electricity generation is not instructed. The electricity generation motor 12 continues the electricity generation driving. When the suspension of electricity generation is instructed, the process proceeds to step S515. In step S515, the electricity generation control unit 264 stops the inverter control.

Figure 6:
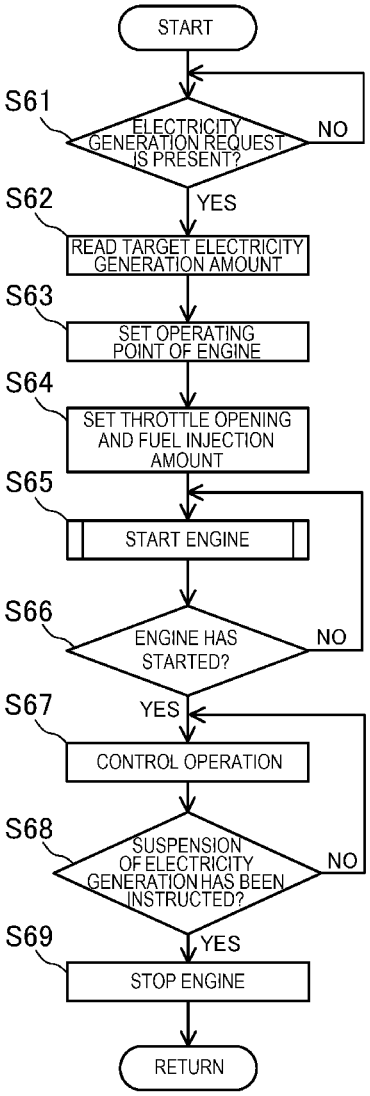
FIG. 6 illustrates a procedure for exemplary engine control.

FIG. 6 illustrates the control procedure for the rotary engine 3 to be performed by the engine ECU 25. In step S61 after the start, first, the engine ECU 25 determines whether an electricity generation request from the battery ECU 27 is present. The process repeats step S61 when no electricity generation request is present or the process proceeds to step S62 when an electricity generation request is present.

In step S62, the engine ECU 25 reads the target electricity generation amount calculated by the battery ECU 27. In subsequent step S63, the engine operating point setting unit 251 of the engine ECU 25 sets the operating point of the rotary engine 3 based on the target electricity generation amount. In addition, in step S64, the engine control unit 252 of the engine ECU 25 sets the opening of the throttle valve 394 and the amount of fuel injection so that the rotary engine 3 operates at the set operating point.

In step S65, engine start control is performed. This engine start control is performed by using the electricity generation motor 12 as a starter. Accordingly, this engine start control is performed in coordination between the engine ECU 25 and the motor ECU 26 as described later. Details on the engine start control will be described later with reference to FIG. 7.

In step S66, the engine ECU 25 determines whether the rotary engine 3 has started. When the rotary engine 3 has not started, the process returns to step S65. When the rotary engine 3 has started, the process proceeds to step S67.

In step S67, the engine control unit 252 of the engine ECU 25 operates the rotary engine 3 at the set operating point. In subsequent step S68, the engine ECU 25 determines whether the suspension of electricity generation has been instructed. While the suspension of electricity generation is not instructed, the process returns to step S67 and the engine control unit 252 continues to operate the rotary engine 3. When the suspension of electricity generation has been instructed, the process proceeds from step S68 to step S69. In step S69, the engine ECU 25 stops the rotary engine 3.

Start Control of Rotary Engine

Figure 7:
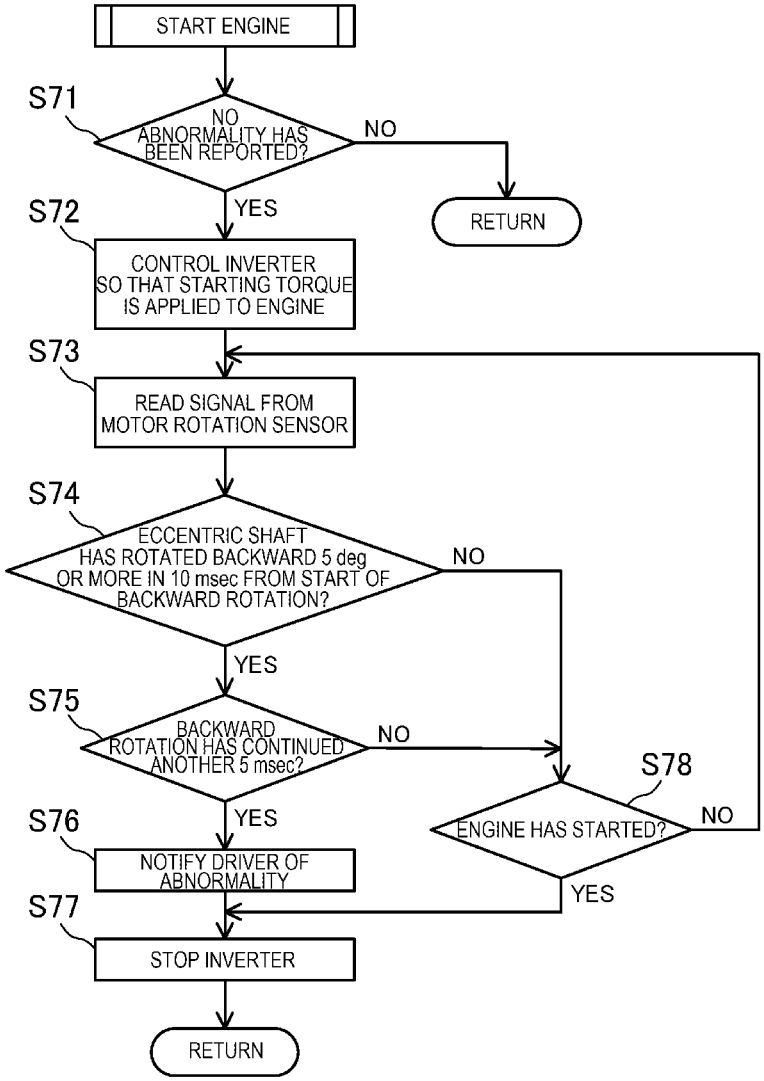
FIG. 7 illustrates a procedure for exemplary engine starting.

FIG. 7 illustrates the procedure for the engine start control in step S65 of the flow in FIG. 6. Since the electricity generation motor 12 performs both power running and electricity generation driving, the electricity generation motor 12 may rotate backward because of the structure thereof when electric power is supplied. Since the electricity generation motor 12 and the eccentric shaft 35 of the rotary engine 3 are mechanically connected to each other, when the electricity generation motor 12 rotates backward, the rotary engine 3 also rotates backward. When the rotary engine 3 rotates backward, the end of the side seal 343 interferes with the opening of the intake port 391 formed in the side housing 33, possibly damaging the side seal 343.

FIG. 4 illustrates the state of the interference between the end of the side seal 343 and the opening of the intake port 391. The side seal 343 is attached to the side surface of the rotor 34. The side seal 343 is provided along the outer circumferential edge of the substantially triangular rotor 34 so as to run between the apex portions of the triangular rotor 34.

The locus of the front end of the side seal 343 when the rotary engine 3 rotates forward does not intersect the edge of the opening of the intake port 391 as indicated by the dot-dot-dash arrow in the diagram on the upper side in FIG. 4. When the rotary engine 3 rotates forward, the front end of the side seal 343 does not interfere with the opening of the intake port 391. However, the locus of the front end of the side seal 343 when the rotary engine 3 rotates backward intersects the edge of the opening of the intake port 391 as indicated by the dot-dash arrow in the diagram on the upper side in FIG. 4. It should be noted that the front end of the side seal 343 when the rotor 34 rotates backward is opposite to the front end of the side seal 343 when the rotor 34 rotates forward.

The drawing on the lower side in FIG. 4 is a sectional view taken along line A-A in the drawing on the upper side. As illustrated in the drawing on the lower side in FIG. 4, a groove 344 is formed in the side surface of the rotor 34. A spring 345 provided in this groove 344 pushes the side seal 343 toward the side housing 33. Accordingly, when the front end of the side seal 343 overlaps the opening of the intake port 391, the front end of the side seal 343 is pushed by the spring 345 and projects to the inside of the intake port 391, that is, upward in the sheet of the diagram on the lower side in FIG. 4.

Accordingly, when the locus of the front end of the side seal 343 intersects the edge of the opening of the intake port 391 due to the backward rotation of the rotor 34, the projecting front end of the side seal 343 may collide with a vertical wall 393 of the opening of the intake port 391 and may damage the side seal 343.

Therefore, the motor ECU 26 prevents the rotor 34 from rotating backward significantly at the start of the rotary engine 3.

It should be noted that, when the rotor 34 rotates forward, the rear end of the side seal 343 is also pushed by the spring 345 and projects to the inside of the intake port 391 when the rear end overlaps the opening of the intake port 391. However, since the rear end of the side seal 343 moves from the left to the right on the sheet of the drawing on the lower side in FIG. 4, the rear end of the side seal 343 does not collide with the edge of the opening of the intake port 391.

The process returns to the flow in FIG. 7 and the engine ECU 25 determines in step S71 whether no abnormality about the start of the engine has been reported previously. The anomaly here is the backward rotation of the electricity generation motor 12 that starts the rotary engine 3. When no abnormality has been reported, the process proceeds to step S72. When an abnormality has been reported, the process ends. The restart of the rotary engine 3 is aborted.

In step S72, the start control unit 263 in the motor ECU 26 controls the second inverter 22 so that the starting torque is applied to the rotary engine 3.

In step S73, the start control unit 263 reads the signal from the motor rotation sensor SN4. In subsequent step S74, based on the signal from the motor rotation sensor SN4, the motor ECU 26 determines whether the eccentric shaft 35 mechanically connected to the electricity generation motor 12 rotates backward together with the backward rotation of the electricity generation motor 12 and the eccentric shaft 35 continues to rotate backward 5 degrees or more in 10 milliseconds from the start of the backward rotation. The output signal from the motor rotation sensor SN4 stating the backward rotation for more than 5 degrees in 10 milliseconds means that the backward rotation is not the occurrence of a mere vibration. That is, the output signal stating the backward rotation for more than 5 degrees in 10 milliseconds means that the electricity generation motor 12 has rotated backward and the rotary engine 3 has also rotated backward accordingly. The motor ECU 26 can prevent the misjudgment concerning the backward rotation of the rotary engine 3 by adopting this determination condition.

When the determination in step S74 is NO, the electricity generation motor 12 and the rotary engine 3 are not rotating backward, so the process proceeds to step S78. In contrast, when the determination in step S74 is YES, the electricity generation motor 12 and the rotary engine 3 may be rotating backward, so the process proceeds to step S75.

In step S75, based on the output signal from the motor rotation sensor SN4, the start control unit 263 determines whether, after the electricity generation motor 12 and the rotary engine 3 have rotated backward 5 degrees or more in 10 milliseconds, this backward rotation has continued another 5 milliseconds. The output signal from the motor rotation sensor SN4 stating that the backward rotation has continued another 5 milliseconds eliminates the effect of noise in the electric signal from the sensor and enables a determination as to whether the electricity generation motor 12 and the rotary engine 3 are actually rotating backward.

When the determination in step S75 is NO, it can be determined that neither the electricity generation motor 12 nor the rotary engine 3 is rotating backward, so the process proceeds to step S78. In step S78, the start control unit 263 determines whether the rotary engine 3 has started. When the rotary engine 3 has not started, the process returns to step S73. When the rotary engine 3 has started, the process proceeds to step S77.

In contrast, when the determination in step S75 is YES, it can be determined that both the electricity generation motor 12 and the rotary engine 3 are rotating backward, so the process proceeds to step S76.

In step S76, the start control unit 263 notifies the driver of an abnormality through the warning light 41 of the instrument panel. In subsequent step S77, the motor ECU 26 stops the electricity generation motor 12 by stopping the second inverter 22.

Here, based on the determination in step S74 and step S75, it can be seen that at least 15 milliseconds have been passed since the electricity generation motor 12 and the rotary engine 3 started backward rotation. The supply of electric power from the second inverter 22 to the electricity generation motor 12 is stopped after a lapse of 15 milliseconds. The rotary engine 3 continues to rotate backward due to inertia even after the supply of electric power is suspended.

In the rotational position of the rotor 34 before the start in this the rotary engine 3, one of the operating chambers is in the middle period of the compression stroke as illustrated in P37 in FIG. 3. This is because, as the compression stroke advances in the order of the beginning period, the middle period, and the later period that correspond to P32, P36, and P37 in the state in which the rotary engine rotates due to inertia immediately before the rotary engine 3 stops, the pressure in the operating chamber rises and acts as the rotational resistance against the rotary engine 3. More specifically, the rotary engine 3 stops at a rotational position of approximately 90 degrees ATDC. It should be noted that the TDC is 540 degrees in FIG. 3.

When the eccentric shaft 35 rotates backward 135 degrees from this position, the end of the side seal 343 interferes with the opening of the intake port 391. In order to reliably avoid the interference between the end of the side seal 343 and the opening of the intake port 391, it is preferable to stop the eccentric shaft before the position corresponding a backward rotation of 70 degrees, which is about half of 135 degrees, in consideration of the safety rate even if the rotary engine 3 continues to rotate backward due to inertia after the supply of electric power to the electricity generation motor 12 is stopped.

Figure 8:
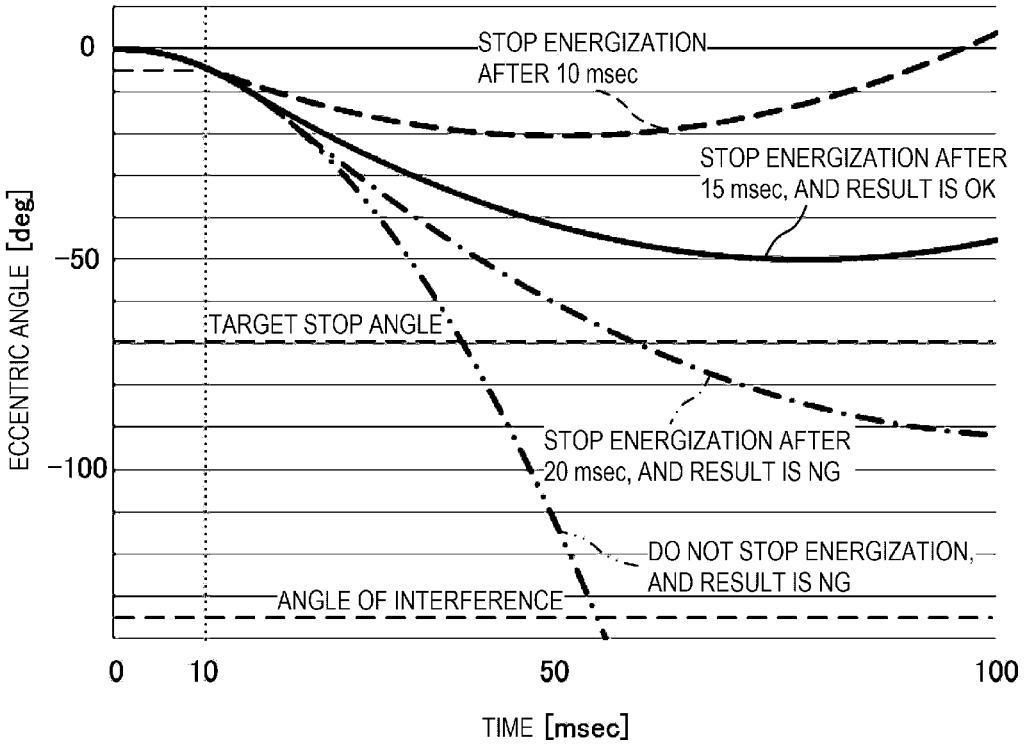
FIG. 8 illustrates simulation results of exemplary backward rotation.

FIG. 8 illustrates the simulation results of calculation of the rotational position at which the eccentric shaft 35 stops when the timing at which the supply of electric power stops is changed. The vertical axis in FIG. 8 represents the angle of the eccentric shaft 35. Zero on the vertical axis represents the angle of the eccentric shaft 35 before the start of the rotary engine 3 (see P37 in FIG. 3). A negative angle indicates an angle of backward rotation. An angle of −135 degrees is the angle at which the end of the side seal 343 interferes with the opening of the intake port 391. An angle of −70 degrees corresponds to the target position at which the eccentric shaft 35 stops. In addition, the horizontal axis in FIG. 8 represents time. Zero on the horizontal axis represents the timing at which the backward rotation of the electricity generation motor 12 starts. The time advances from the left to the right.

The dot-dot-dash line in FIG. 8 indicates an example in which the supply of electric power to the electricity generation motor 12 is not aborted after the backward rotation of the electricity generation motor 12 is started. The electricity generation motor 12 and the rotary engine 3 rotate backward 5 degrees in 10 milliseconds. After that, electric power is supplied to the electricity generation motor 12. In this case, since the angle of the eccentric shaft 35 exceeds −135 degrees, the end of the side seal 343 interferes with the opening of the intake port 391.

The dot-dash line in FIG. 8 indicates an example in which the electricity generation motor 12 starts rotating backward and rotates backward 5 degrees in 10 milliseconds, the supply of electric power to the electricity generation motor 12 is continued only for 10 milliseconds, and the supply of electric power to the electricity generation motor 12 is aborted. The rotary engine 3 continues to rotate backward due to inertia after a lapse of 20 milliseconds. In this case, the eccentric shaft 35 rotates up to approximately −90 degrees. The eccentric shaft 35 exceeds the target stop angle.

The solid line in FIG. 8 indicates an example in which the electricity generation motor 12 starts rotating backward and rotates backward 5 degrees in 10 milliseconds, the supply of electric power to the electricity generation motor 12 is continued for another 5 milliseconds, and the supply of electric power to the electricity generation motor 12 is aborted. This condition corresponds to the conditions of step S74 and step S75 of the flow in FIG. 7. In this case, the eccentric shaft 35 rotates up to approximately −50 degrees. The eccentric shaft 35 does not exceed the target stop angle.

The dashed line in FIG. 8 indicates an example in which the electricity generation motor 12 starts rotating backward and rotates backward 5 degrees in 10 milliseconds, and then the supply of electric power to the electricity generation motor 12 is aborted. This condition corresponds to the condition in which step S75 of the flow in FIG. 7 has been omitted. In this case, the eccentric shaft 35 rotates up to approximately −20 degrees. The eccentric shaft 35 does not exceed the target stop angle. However, if step S75 is omitted, the motor ECU 26 may make a misjudgment by being affected by noise from the motor rotation sensor SN4.

Since the backward rotation of the eccentric shaft 35 is stopped early by stopping the supply of electric power to the electricity generation motor 12 early, the interference between the side seal 343 and the opening of the intake port 391 can be avoided. However, the motor ECU 26 may make a misjudgment. According to the simulation results in FIG. 8, the interference between the side seal 343 and the opening of the intake port 391 can also be avoided by continuing the supply of electric power to the electricity generation motor 12 for 15 milliseconds. In other words, the motor ECU 26 can use a time of 15 milliseconds to determine backward rotation. By using a time of 15 milliseconds to determine backward rotation, the motor ECU 26 can achieve both the avoidance of the damage caused by the backward rotation of the rotary engine and the avoidance of a misjudgment of the backward rotation of the rotary engine.

In addition, when the eccentric shaft 35 rotates backward 5 degrees in 10 milliseconds, the motor ECU 26 can distinguish between occurrence of vibration at the start of the rotary engine 3 and the actual backward rotation of the electricity generation motor 12 and the rotary engine 3.

Accordingly, by combining two conditions of step S74 and step S75 in FIG. 7 with each other, the motor ECU 26 can stop the backward rotation of the rotary engine 3 before the end of the side seal 343 interferes with the opening of the intake port 391 formed in the side housing 33 while suppressing a misjudgment.

Modifications of Engine Control

The conditions of step S74 and step S75 of the flowchart in FIG. 7 are set based on a predetermined maximum starting torque of the electricity generation motor 12 and predetermined inertia of the rotary engine 3. When the specifications of the electricity generation motor 12 and/or the specifications of the rotary engine 3 change, even if the electricity generation motor 12 is energized for the same time, the angle of the backward rotation of the eccentric shaft 35 including rotation due to inertia can be larger. Even when the supply of electric power to the electricity generation motor 12 is stopped according to the conditions in step S74 and step S75, the end of the side seal 343 may interfere with the opening of the intake port 391.

Figure 9:
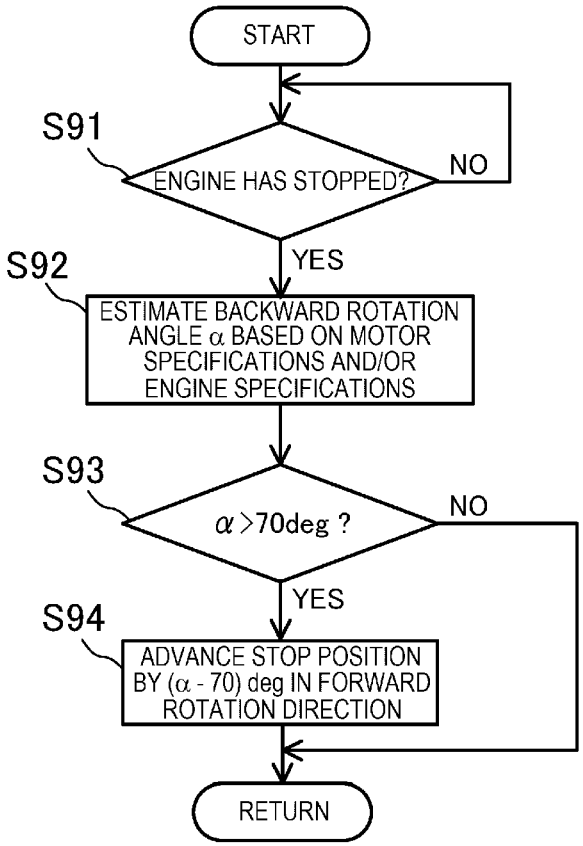
FIG. 9 illustrates a procedure for engine control procedure according to a modification.

The flow in FIG. 9 relates to the engine control that adjusts the stop position of the rotary engine 3 according to the motor specifications and/or the engine specifications. In step S91 after the start, first, the stop position control unit 265 of the motor ECU 26 determines whether the rotary engine 3 has stopped. When the engine has not stopped, the process repeats step S91. When the engine has stopped, the process proceeds to step S92.

In step S92, the stop position control unit 265 estimates the rotation angle α of the eccentric shaft 35 based on the motor specifications and/or the engine specifications when continuing the supply of electric power to the electricity generation motor 12 for 15 milliseconds from the start of backward rotation and then stopping the supply of electric power to the electricity generation motor 12. The motor specifications include the maximum starting torque of the electricity generation motor 12 and the engine specifications include the inertia of the rotary engine 3. In addition, the rotation angle α includes the rotation of the rotary engine 3 due to inertia.

Then, in step S93, the stop position control unit 265 determines whether the estimated rotation angle α exceeds 70 degrees. When the estimated rotation angle α does not exceed 70 degrees, it can be predicted that the eccentric shaft 35 stops at an angle less than 70 degrees if the supply of electric power to the electricity generation motor 12 is stopped according to the conditions of step S74 and step S75 of the flowchart in FIG. 7. The process returns from step S93 without correcting the stop position of the rotary engine 3.

In contrast, in step S93, when the stop position control unit 265 determines that the estimated rotation angle α exceeds 70 degrees, it can be predicted that the eccentric shaft 35 stops at an angle more than 70 degrees if the supply of electric power to the electricity generation motor 12 is stopped according to the conditions of step S74 and step S75 in the flowchart in FIG. 7. The stop position control unit 265 corrects the stop position of the rotary engine 3 because the eccentric shaft 35 does not stop at the target position. Specifically, the process proceeds from step S93 to step S94, and the stop position control unit 265 advances the rotational position of the stopped rotary engine 3 in the forward rotation direction by (α−70) degrees by causing the electricity generation motor 12 to perform power running. The rotational position of the rotary engine 3 changes in the forward rotation direction from P37 in FIG. 3. As a result, even if the electricity generation motor 12 rotates backward at the next start of the rotary engine 3, the motor ECU 26 can stop the backward rotation of the eccentric shaft 35 according to the flowchart in FIG. 7 before the end of the side seal 343 interferes with the opening of the intake port 391.

Second Modification of Engine Control

Figure 10:
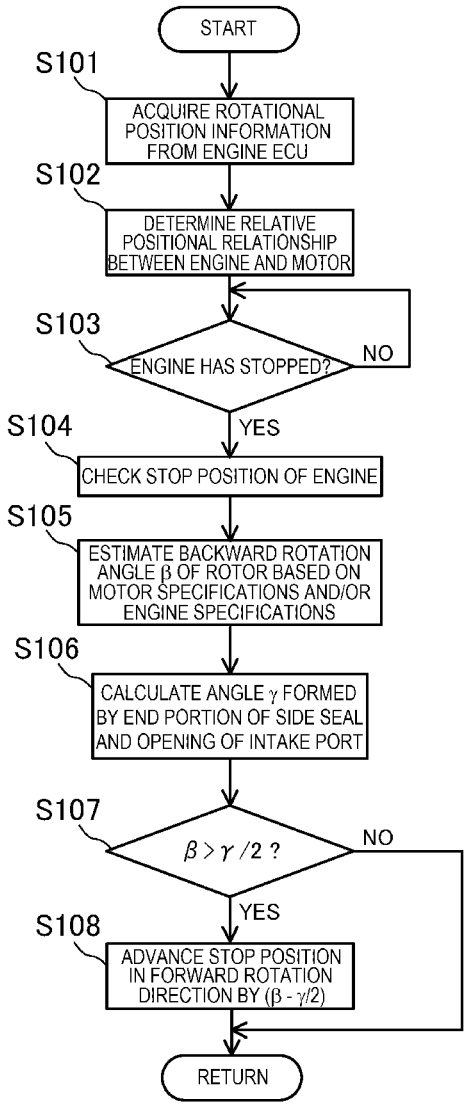
FIG. 10 illustrates a procedure for engine control procedure according to a modification.

The flowchart in FIG. 10 relates to the engine control that can support various motor specifications and/or engine specifications. In step S101 after the start, first, the stop position control unit 265 of the motor ECU 26 acquires the engine rotational position information from the engine ECU 25. In subsequent step S102, the stop position control unit 265 determines the relative positional relationship between the rotary engine 3 and the electricity generation motor 12 based on the engine rotational position information acquired in step S101. Since the eccentric shaft 35 of the rotary engine 3 is mechanically connected to the electricity generation motor 12, the relative positional relationship between the rotational position of the rotary engine 3 and the rotational position of the electricity generation motor 12 checked while the rotary engine 3 is operated and the electricity generation motor 12 generates electricity does not change even after the rotary engine 3 stops. Accordingly, after the relative positional relationship is determined, the motor ECU 26 can acquire the rotational positions of the rotary engine 3 and the electricity generation motor 12 based only on the output signal from the motor rotation sensor SN4.

In step S103, the motor ECU 26 determines whether the rotary engine 3 has stopped. The motor ECU 26 can determine that the rotary engine 3 has stopped based on, for example, only the output signal from the motor rotation sensor SN4. The process repeats step S103 when the determination in step S103 is NO or the process proceeds to step S104 when the determination in step S103 is YES.

In step S104, the motor ECU 26 checks the stop position of the rotary engine 3 based on the output signal from the motor rotation sensor SN4 when the rotary engine 3 stops. Immediately before the engine stops when the rotation speed of the rotary engine 3 reduces, the engine ECU 25 cannot easily grasp the rotational position of the rotary engine 3 accurately based on the signal from the eccentric angle sensor SN1. This is because the sampling frequency of the engine ECU 25 is relatively low. In contrast, the sampling frequency of the motor ECU 26 is relatively high. Based on the relative positional relationship between the rotational position of the rotary engine 3 and the rotational position of the electricity generation motor 12, which has been determined in advance, and the signal from the motor rotation sensor SN4, the motor ECU 26 can grasp the rotational position of the rotary engine 3 even immediately before the engine stops.

In step S105, the stop position control unit 265 estimates angle β of the rotor 34 when the supply of electric power to the electricity generation motor 12 is continued for 15 milliseconds from the start of backward rotation and then the supply of electric power to the electricity generation motor 12 is stopped, based on the motor specifications and/or engine specifications. Unlike step S82 in which angle α of the eccentric shaft 35 is estimated, the motor ECU 26 estimates angle β of the rotor 34.

In subsequent step S106, based on the stop position and engine specifications of the rotary engine 3 checked in step S104, the motor ECU 26 calculates angle γ formed by the end of the side seal 343 and the opening of the intake port 391 at the stop position. Angle γ is equivalent to the allowable angle below which the end of the side seal 343 does not interfere with the opening of the intake port 391 when the electricity generation motor 12 rotates backward.

Then, in step S107, the motor ECU 26 determines whether angle β estimated in step S105 is larger than half of angle γ calculated in step S96. Here, the reason for using γ/2 is to associate this angle with the setting of the target stop position to 70 degrees, which is about half of 135 degrees described above. When the determination in step S107 is NO, by stopping the supply of electric power to the electricity generation motor 12 according to the conditions of step S74 and step S75 in the flowchart in FIG. 7, the interference between the end of the side seal 343 and the opening of the intake port 391 can be avoided. The process returns from step S107 without correcting the stop position of the rotary engine 3.

When the motor ECU 26 determines that the estimated rotation angle β exceeds γ/2 in step S107, it can be expected that the end of the side seal 343 interferes with the opening of the intake port 391 if the motor ECU 26 stops the supply of electric power to the electricity generation motor 12 according to the conditions in step S74 and step S75 of the flowchart in FIG. 7. Accordingly, the motor ECU 26 corrects the stop position of the rotary engine 3. Specifically, the process proceeds to step S108 from step S107 and the motor ECU 26 advances the rotational position of the rotary engine 3 in the forward rotation direction by (β−γ/2) using the electricity generation motor 12. As a result, even if the electricity generation motor 12 rotates backward at the next start of the rotary engine 3, the motor ECU 26 can prevent interference between the end of the side seal 343 and the opening of the intake port 391 according to the flowchart in FIG. 7.

It should be noted that each of the flows described above does not necessarily define the order of the steps. The order of steps can be changed to the extent possible and processing including a plurality of steps may be performed at the same time. In addition, some steps can be omitted or a new step can be added in the flows.

In addition, the system illustrated in FIG. 1 is an example and the system to which the technology disclosed herein is applicable is not limited to the system in FIG. 1. In addition, the technology disclosed herein is widely applicable to control systems for rotary engines and the structure of such a rotary engines is not limited to the structure in FIG. 2.

What is claimed is:

1. A control device for a rotary engine, the control device comprising:

a rotary engine having an intake port opened in a side housing;

a motor mechanically connected to a shaft of the rotary engine;

a controller that performs energization control of the motor so as to start the rotary engine by driving the motor; and a sensor that outputs an electric signal concerning a rotation direction of the rotary engine to the controller, wherein the controller stops energization to the motor based on the electric signal from the sensor when the shaft of the rotary engine rotates backward a predetermined angle or more and then the shaft of the rotary engine continues to rotate backward for a predetermined time at a start of the rotary engine.

2. The control device for a rotary engine according to claim 1, wherein the controller stops energization to the motor so that the shaft of the rotary engine stops before the shaft rotates 70 degrees after a start of backward rotation.

3. The control device for a rotary engine according to claim 2, wherein the predetermined angle is 5 degrees in 10 milliseconds after the start of backward rotation.

4. The control device for a rotary engine according to claim 3, wherein the predetermined time is 5 milliseconds.

5. The control device for a rotary engine according to claim 4, wherein the controller estimates, based on a maximum starting torque of the motor and inertia of the rotary engine, a rotation angle of the shaft when stopping energization to the motor after a lapse of 15 milliseconds from a start of backward rotation, and when the estimated angle exceeds 70 degrees, the controller changes a rotational position of the shaft before starting the rotary engine in a forward rotation direction using the motor.

6. The control device for a rotary engine according to claim 4, wherein the controller estimates, based on a maximum starting torque of the motor and inertia of the rotary engine, a rotation angle of the shaft when stopping energization to the motor after a lapse of 15 milliseconds from a start of backward rotation, and when an end of a side seal of the rotary engine interferes with an opening of the intake port if the shaft rotates backward the estimated rotation angle, the controller changes a rotational position of the shaft before starting the rotary engine in a forward rotation direction using the motor.

7. The control device for a rotary engine according to claim 2, wherein the predetermined time is 5 milliseconds.

8. The control device for a rotary engine according to claim 7, wherein the controller estimates, based on a maximum starting torque of the motor and inertia of the rotary engine, a rotation angle of the shaft when stopping energization to the motor after a lapse of 15 milliseconds from a start of backward rotation, and when the estimated angle exceeds 70 degrees, the controller changes a rotational position of the shaft before starting the rotary engine in a forward rotation direction using the motor.

9. The control device for a rotary engine according to claim 7, wherein the controller estimates, based on a maximum starting torque of the motor and inertia of the rotary engine, a rotation angle of the shaft when stopping energization to the motor after a lapse of 15 milliseconds from a start of backward rotation, and when an end of a side seal of the rotary engine interferes with an opening of the intake port if the shaft rotates backward the estimated rotation angle, the controller changes a rotational position of the shaft before starting the rotary engine in a forward rotation direction using the motor.

10. The control device for a rotary engine according to claim 1, wherein the predetermined angle is 5 degrees in 10 milliseconds after the start of backward rotation.

11. The control device for a rotary engine according to claim 10, wherein the predetermined time is 5 milliseconds.

12. The control device for a rotary engine according to claim 11, wherein the controller estimates, based on a maximum starting torque of the motor and inertia of the rotary engine, a rotation angle of the shaft when stopping energization to the motor after a lapse of 15 milliseconds from a start of backward rotation, and when the estimated angle exceeds 70 degrees, the controller changes a rotational position of the shaft before starting the rotary engine in a forward rotation direction using the motor.

13. The control device for a rotary engine according to claim 11, wherein the controller estimates, based on a maximum starting torque of the motor and inertia of the rotary engine, a rotation angle of the shaft when stopping energization to the motor after a lapse of 15 milliseconds from a start of backward rotation, and when an end of a side seal of the rotary engine interferes with an opening of the intake port if the shaft rotates backward the estimated rotation angle, the controller changes a rotational position of the shaft before starting the rotary engine in a forward rotation direction using the motor.

14. The control device for a rotary engine according to claim 1, wherein the predetermined time is 5 milliseconds.

15. The control device for a rotary engine according to claim 14, wherein the controller estimates, based on a maximum starting torque of the motor and inertia of the rotary engine, a rotation angle of the shaft when stopping energization to the motor after a lapse of 15 milliseconds from a start of backward rotation, and when the estimated angle exceeds 70 degrees, the controller changes a rotational position of the shaft before starting the rotary engine in a forward rotation direction using the motor.

16. The control device for a rotary engine according to claim 14, wherein the controller estimates, based on a maximum starting torque of the motor and inertia of the rotary engine, a rotation angle of the shaft when stopping energization to the motor after a lapse of 15 milliseconds from a start of backward rotation, and when an end of a side seal of the rotary engine interferes with an opening of the intake port if the shaft rotates backward the estimated rotation angle, the controller changes a rotational position of the shaft before starting the rotary engine in a forward rotation direction using the motor.

* * * * *